US008505855B2

(12) United States Patent
Kikuchi et al.

(10) Patent No.: US 8,505,855 B2
(45) Date of Patent: Aug. 13, 2013

(54) TRAIN DETECTOR AND TRAIN SECURITY DEVICE FOR DUAL GAUGE TRACK CIRCUIT

(75) Inventors: Kenji Kikuchi, Hitachi (JP); Koushirou Sakado, Hitachinaka (JP); Kentaro Ohkubo, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 212 days.

(21) Appl. No.: 13/008,260

(22) Filed: Jan. 18, 2011

(65) Prior Publication Data

US 2011/0174934 A1 Jul. 21, 2011

(30) Foreign Application Priority Data

Jan. 18, 2010 (JP) ..... 2010-008080

(51) Int. Cl.
*B61L 25/02* (2006.01)

(52) U.S. Cl.
USPC ..... 246/122 A; 246/122 R

(58) Field of Classification Search
USPC ..... 246/122 A, 122 R, 123, 124
See application file for complete search history.

(56) References Cited

U.S. PATENT DOCUMENTS

| | | | | |
|---|---|---|---|---|
| 5,720,454 | A * | 2/1998 | Bachetti et al. | 246/34 R |
| 6,011,508 | A * | 1/2000 | Perreault et al. | 342/350 |
| 6,216,985 | B1 * | 4/2001 | Stephens | 246/120 |
| 6,729,584 | B2 * | 5/2004 | Ireland | 246/122 A |
| 7,481,400 | B2 * | 1/2009 | Appleby et al. | 246/249 |
| 2001/0015578 | A1 * | 8/2001 | Westlake | 307/125 |
| 2003/0038216 | A1 * | 2/2003 | Holgate | 246/122 R |
| 2004/0227036 | A1 * | 11/2004 | Arita et al. | 246/209 |
| 2008/0142645 | A1 * | 6/2008 | Tomlinson et al. | 246/122 R |
| 2011/0174934 | A1 * | 7/2011 | Kikuchi et al. | 246/122 R |

FOREIGN PATENT DOCUMENTS

| | | |
|---|---|---|
| JP | 4-52971 | 5/1992 |
| JP | 2002-308095 | 10/2002 |

OTHER PUBLICATIONS

Latest Electric Railway Engineering, The Institute of Electrical Engineers of Japan, Education Investigation Commission on Electric Railways, Sep. 11, 2000, pp. 216-218, Corona Publishing Co., Ltd.

* cited by examiner

*Primary Examiner* — Jason C Smith
(74) *Attorney, Agent, or Firm* — Antonelli, Terry, Stout & Kraus, LLP.

(57) ABSTRACT

When a prior art track circuit for monitoring an electric signal supplied to a rail via a transmitter and a receiver connected to the rail for detecting a presence of a train using a phenomenon in which the reception level of a signal drops when axles of a train electrically short two rails together and sending a train control signal to the train is applied to a dual gauge track circuit in which two types of trains having different gauges share a rail, mutual induction between rails occurs which is a problem specific to the dual gauge track circuit, and the amount of attenuation of the train detection signal when a train is present on a track drops. The present invention prevents the mutual induction between rails and suppresses the drop of the amount of attenuation of the train detection signal when a train is present on a track by providing a train detector for recognizing two types of trains and detecting the presence of trains on the track via transmitters and receivers respectively connected to three rails, including filters for passing relevant signals and increasing the impedance of signals of other signal bands disposed on input stages of the respective receivers.

4 Claims, 9 Drawing Sheets

TRAIN DETECTOR AND TRAIN SECURITY DEVICE FOR DUAL GAUGE TRACK CIRCUIT

The present application is based on and claims priority of Japanese patent application No. 2010-008080 filed on Jan. 18, 2010, the entire contents of which are hereby incorporated by reference.

BACKGROUND OF THE INVENTION

1. Field of the Invention

The present invention relates to a train detector and a train security device of a dual gauge track circuit in which two or more types of trains having different gauges, that is, different distances between wheels, share a rail.

2. Description of the Related Art

The most important information for ensuring safety of train operation is to know where the trains are positioned within the track. Track circuits have been developed with this aim. The most popular type of track circuits is a dual rail track circuit in which closed circuits are formed via two rails. The dual rail track circuit constitutes closed circuits in which two rails are electrically separated into arbitrary sections, having transmitters for transmitting train detection signals and receivers for receiving the train detection signals transmitted from the transmitters attached to opposite ends of the sections.

The transmitters and receivers are used to monitor the reception level of train detection signals constantly so as to detect the entry of trains to the relevant section. When a train enters the relevant section between a transmitter and a receiver, the axles of the train electrically short the rails together and the reception level drops. This phenomenon of changes of the reception level is used as the mechanism for detecting entry of trains.

The prior art system devised to constitute respective track circuits for two types of trains having different gauges sharing a common rail and travelling on this dual rail track circuit is a dual gauge track circuit in which three rails are used, as shown in FIG. 8. Such prior art track circuit system is disclosed in non-patent document 1 (The Institute of Electrical Engineers of Japan, Education Investigation Commission on Electric Railways, "Latest Electric Railway Engineering", Corona Publishing Co., Ltd, Published Sep. 11, 2000, pages 216-218).

The dual gauge track circuit shown in FIG. 8 considers performing different controls for the two types of trains having different gauges, and enables to recognize the type of the train present on the track when the presence of a train is detected. Further, the dual gauge track circuit characterizes in that induction occurs via magnetic field coupling among the three rails, and this induction effect greatly influences the transmission of electric signals supplied to the rails.

A train detector utilizing track circuits is a mechanism for detecting the presence of a train by the attenuation of train detection signals caused by the drop of rail impedance when the train enters a relevant section and shorts the rails together via its axles. In the dual gauge track circuit, mutual induction occurs among rails as mentioned earlier. The state of a track circuit when a train enters the track is as shown in FIG. 9, which is an equivalent circuit.

In FIG. 9, a train detection signal transmitted from a transmitter A 4 mainly forms a current loop of current X 8. This current X 8 generates a magnetic field X 11 around the standard track rail 1 and generates a current Y 9 via the magnetic field coupling between the standard track rail 1 and the narrow track rail 2.

Furthermore, the current Y 9 generates a magnetic field Y 12 around the narrow track rail 2 and creates a current Z 10 on the standard track rail 1, and as a result of superposing train detection signals toward the reception side, the reception level is raised and the train detection performance is deteriorated.

SUMMARY OF THE INVENTION

The present invention aims at solving the problems of the prior art by providing a train detector and a train security device in which filters having high impedance with respect to the signals of a closed loop established in a parallel state are disposed on a front stage of receivers for receiving the train detection signals, capable of suppressing the current loops other than the relevant signal generated via mutual induction among rails caused when the train is present on the track, and preventing rising of the reception level.

The present invention enables to suppress the influence of mutual induction among rails specific to the dual gauge track circuit to thereby improve the train detection performance.

DETAILED DESCRIPTION OF THE PREFERRED EMBODIMENTS

Now, we will describe preferred embodiments for preventing the deterioration of train detection performance caused by mutual induction among rails in a dual gauge track circuit in which trains having different gauges share rails.

[Embodiment 1]

Figure 1:
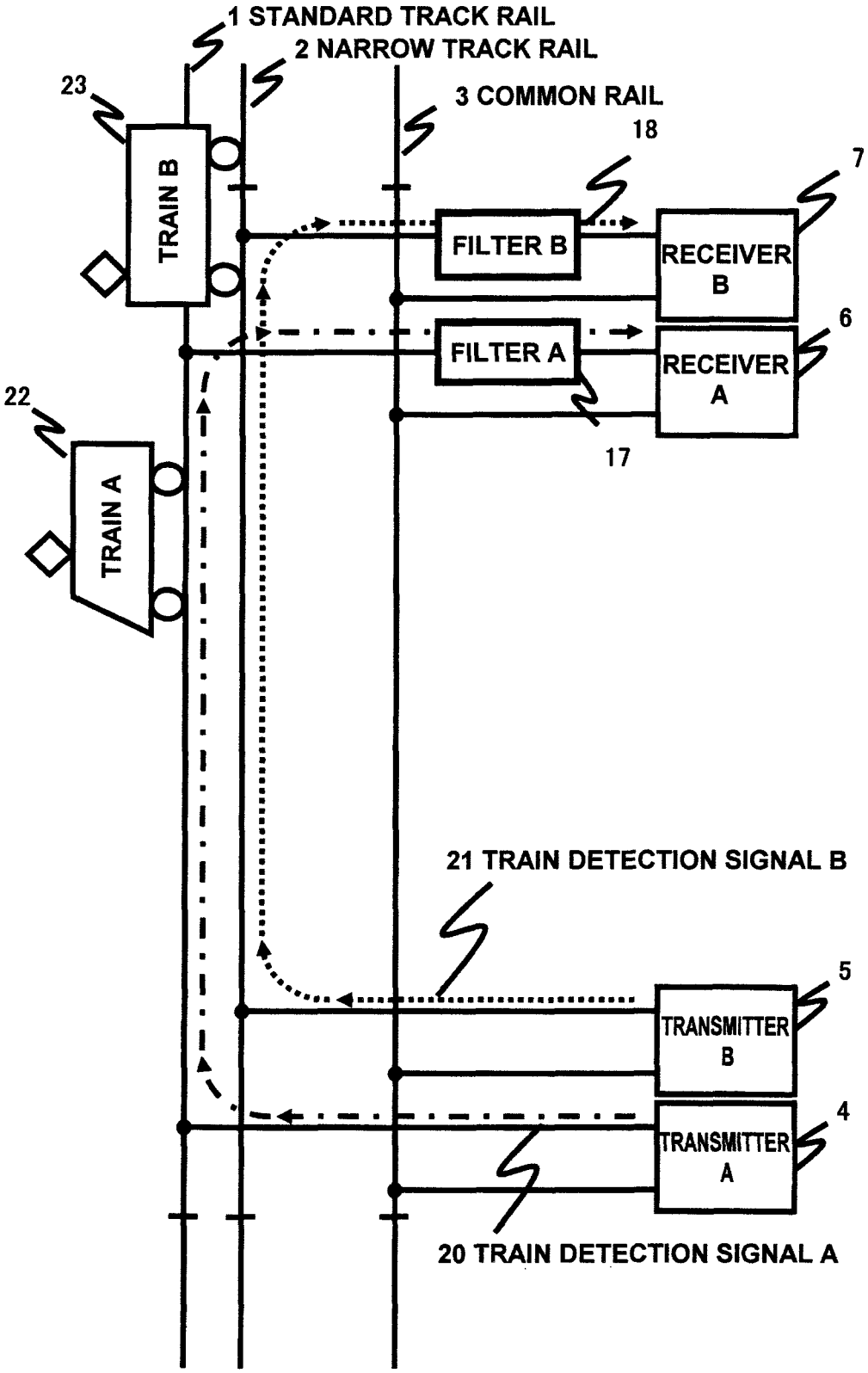
FIG. 1 is an explanatory view showing the arrangement of a train detector for a dual gauge track circuit according to the present invention (embodiment 1)

As shown in FIG. 1, a transmitter A 4 and a receiver A 6 for performing presence detection of a train A 22 and a transmitter B 5 and a receiver B 7 for performing presence detection of a train B 23 in a dual gauge track circuit respectively constitute a closed loop of train detection signals for the respective trains, wherein the presence of a train is detected by the attenuation of reception level caused by the drop of rail impedance when the train entering the track shorts the rails together.

Figure 3:
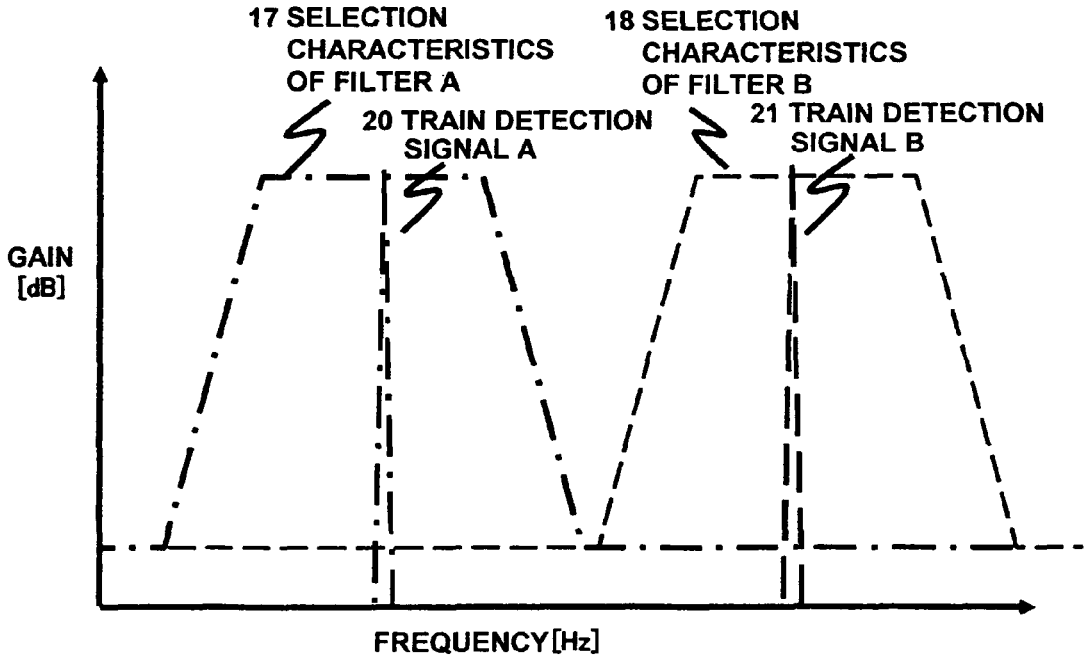
FIG. 3 is an explanatory view showing a filter characteristics applied to the train detector for the dual gauge track circuit (embodiment 1)
Figure 4:
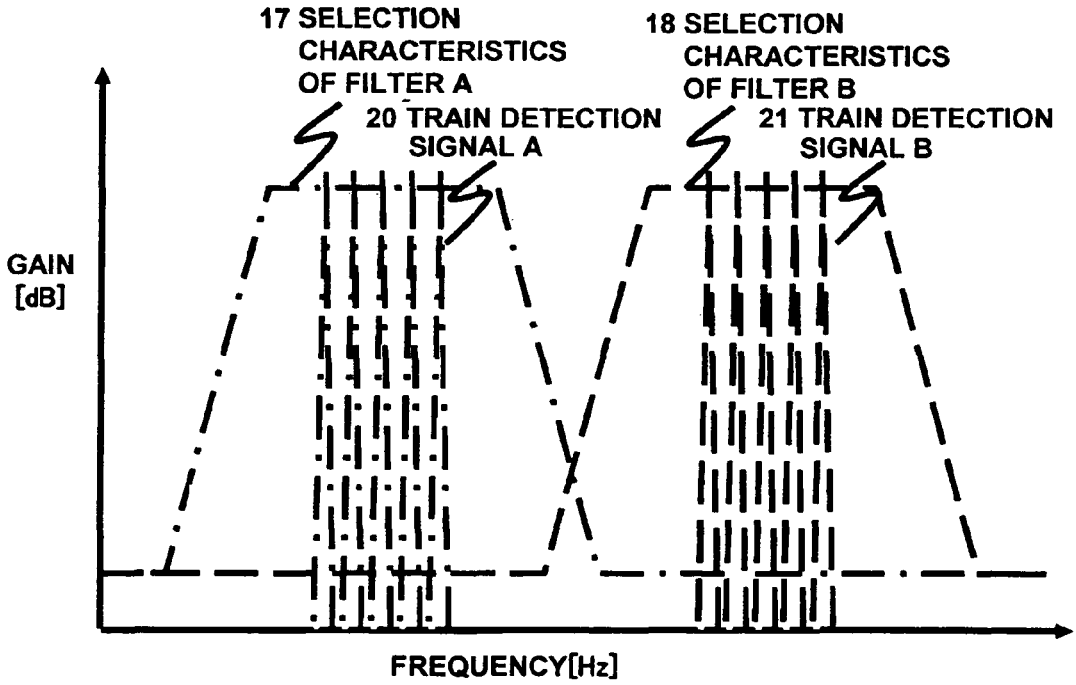
FIG. 4 is an explanatory view showing the filter characteristics applied to the train detector for the dual gauge track circuit (embodiment 2)

Two types of filers A 17 and B 18 are connected to the front stage of the respective receivers in the present system. The pass characteristics of these filters are shown in FIG. 3.

The filter A 17 is designed to pass a train detection signal A 20 of the train A 22 traveling on a standard track rail 1 to which the filter A is connected and to enhance the impedance of the other train detection signal B 21 so as to suppress the current of the train detection signal B 21. In contrast, the filter B 18 is designed to pass a train detection signal B 21 of the train B 23 traveling on a narrow track rail 2 to which the filter B is connected and to enhance the impedance of the other train detection signal A 20 so as to suppress the current of the train detection signal A 20.

The installation of these two filters enables signal currents other than the relevant signals to be suppressed in the respective closed loops, so that the current loops other than the relevant signals caused by mutual induction between rails occurring when a train is present on the track are suppressed and the rising of the reception level is prevented.

[Embodiment 2]

Next, another preferred embodiment is described in which the invention of embodiment 1 is applied to a non-insulated track circuit using common transmitters and receivers among two types of trains having different gauges.

Figure 2:
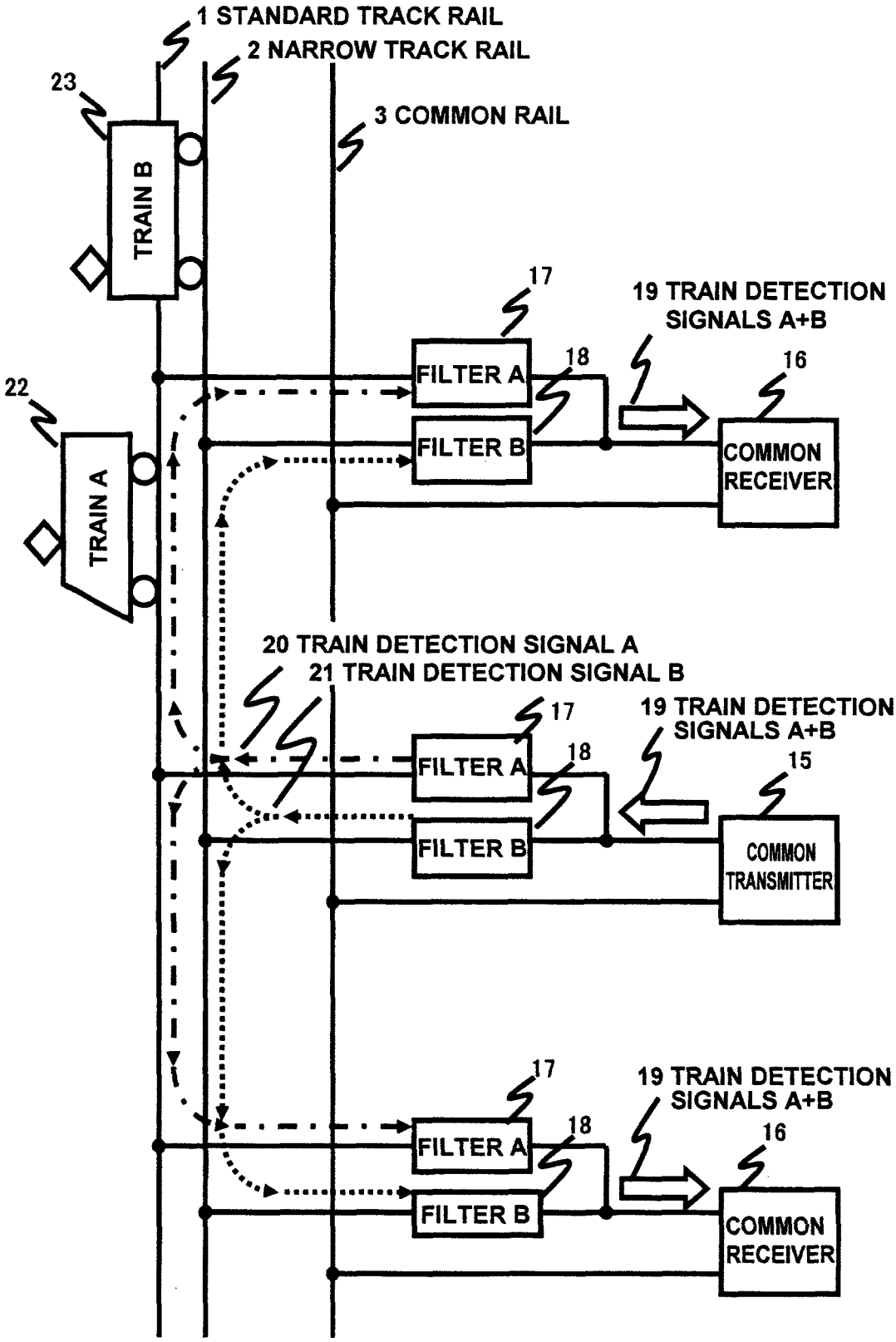
FIG. 2 is an explanatory view showing the arrangement of a train detector for a dual gauge track circuit applied to a non-insulated track circuit in which transmitters and receivers are used in common (embodiment 2)

FIG. 2 is a block diagram illustrating the arrangement of the present embodiment. It is assumed that the train A 22 travels on a standard track rail 1 and a common rail 3, and the train B 23 travels on a narrow track rail 2 and the common rail 3. In order to recognize the type of trains and perform presence detection of trains having two types of gauges, it is necessary to divide the train signal frequencies.

Further, in the case of a non-insulated track, a plurality of frequencies are required to distinguish the adjacent tracks. In the present invention, a train detection signal A 20 for detecting the presence of a train A 22 is set to a lower range, and a train detection signal B 21 for detecting the presence of a train B is set to a higher range.

The frequencies can be set oppositely, since the feature of the present system is to divide the two signal bands into a lower range and a higher range. A filter A 17 is set to pass the train detection signal A 20 and enhance the impedance of the other train detection signal B 21 so as to suppress the current of the train detection signal B 21.

In contrast, a filter B 18 is set to pass the train detection signal B 21 and enhance the impedance of the other train detection signal A 20 so as to suppress the current of the train detection signal A 20. As shown in FIG. 2, the two filters are disposed on the side of the rail having a common transmitter 15 and a common receiver 16.

The common transmitter 15 transmits train detection signals A+B 19 having superposed the train detection signal A 20 and the train detection signal B 21. The train detection signals A+B 19 are passed through the filter A 17 and the filter B 18 and split into the train detection signal A 20 and the train detection signal B 21, so that two closed loops of the train detection signal A 20 and the train detection signal B 21 are independently formed on the three rails.

In the receiver side, the train detection signals having passed through the filter A 17 and the filter B 18 from the rails are entered to a common receiver 16 as train detection signals A+B 19 in which the train detection signal A 20 and the train detection signal B 21 are superposed. The common receiver 16 receives the train detection signals A+B 19 and monitors the respective signal levels of the train detection signal A 20 and the train detection signal B 21.

When the train A 22 or the train B 23 short the two rails together via its axles, only the level of the train detection signal corresponding thereto is lowered, so that the receiver can detect the type of the train and the presence of the train on the track based on the signal frequency whose level is lowered.

Further, as described, the filter A 17 and the filter B 18 are designed so that the relevant train detection signal is passed through and the current of the other train detection signal is suppressed, so that similar to embodiment 1, the current loop other than the relevant signal caused by the mutual induction between rails occurring when a train is present on a track can be suppressed and the rising of the reception level can also be suppressed.

In embodiment 2, as shown in FIG. 2, an example is illustrated in which filters A and B respectively corresponding to the types of trains are arranged on both the output side of the common transmitter and the receiving side of the common receivers. However, this is merely an example, and for example, the receivers A and B illustrated in embodiment 1 can be used together with the common transmitter 15 of embodiment 2. Further, the transmitters A and B illustrated in embodiment 1 can be used together with the common receiver 16 of embodiment 2.

[Embodiment 3]

Next, we will describe a train security device having both functions of train detection and train control, wherein a function for superposing a train control signal 24 to the train detection signals A+B 19 and transmitting the same is additionally provided to the common transmitter 15 of embodiment 2.

Figure 5:
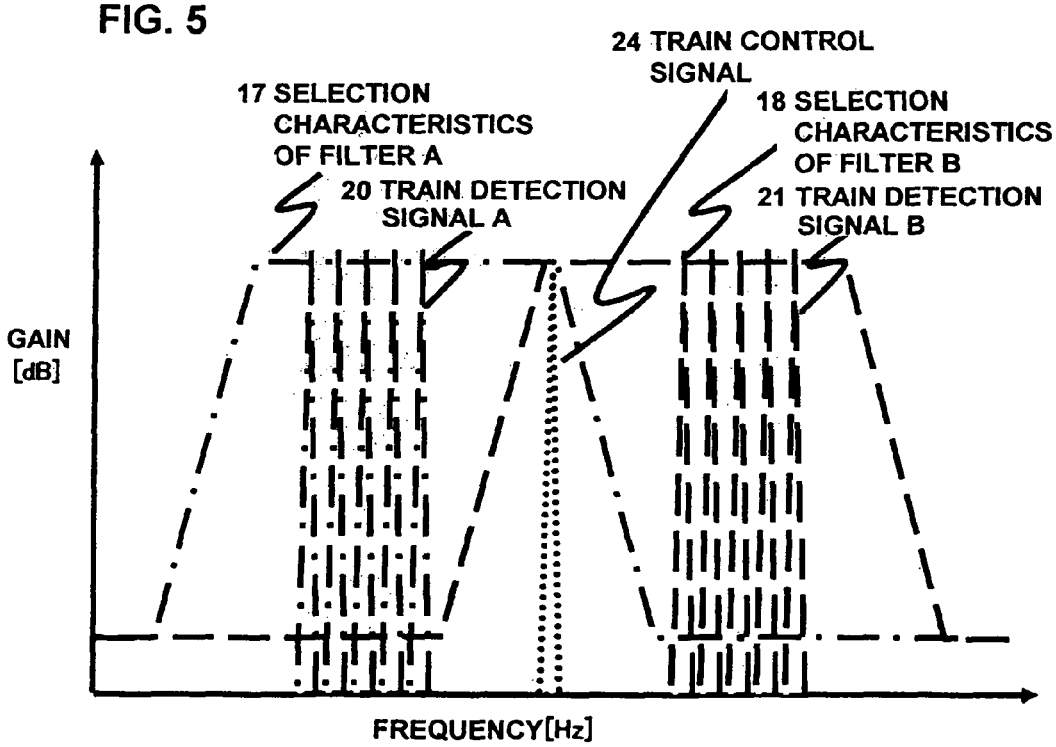
FIG. 5 is an explanatory view showing the filter characteristics applied to a train security device for a dual gauge track circuit (embodiment 3)

FIG. 5 illustrates an example of the arrangement of signal frequencies according to embodiment 2. Similar to embodiment 2, a train detection signal A 20 and a train detection signal B 21 are arranged, and a train control signal 24 used in common for both the train A 22 and the train B 23 is arranged in the band range in the middle of the detection signals. The selection characteristics of the filter A 17 is set so that the train detection signal A 20 and the train control signal 24 are passed while the train detection signal B 21 is blocked, and the selection characteristics of the filter B 18 is set so that the train detection signal B 21 and the train control signal 24 are passed while the train detection signal A 21 is blocked.

Figure 6:
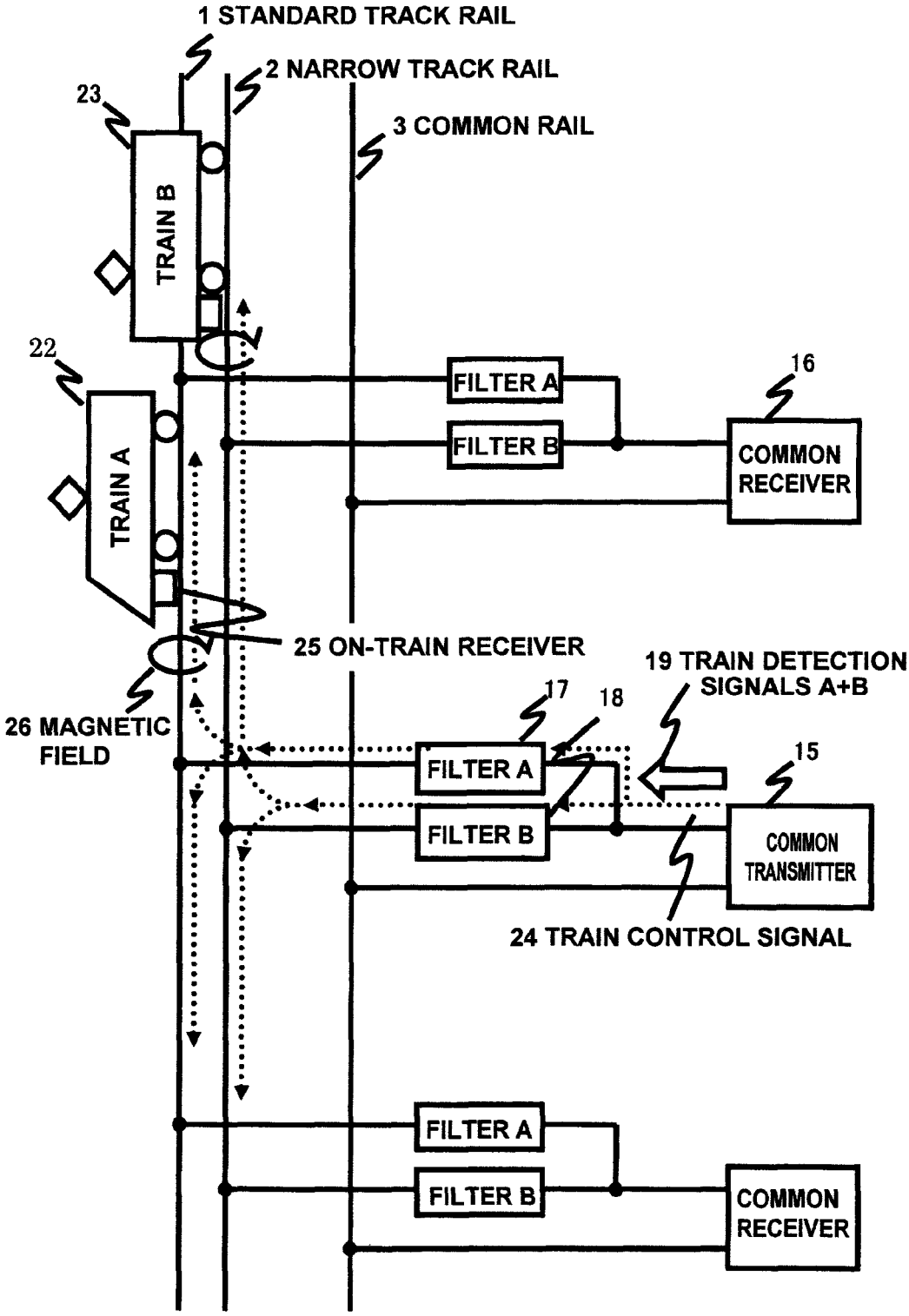
FIG. 6 is an explanatory view showing the arrangement of the train security device for a non-insulated dual gauge track circuit (embodiment 3)

These two types of filters are arranged on the side of the rail having the common transmitter 15 and the common receiver 16 similar to embodiment 2, as shown in FIG. 6. Thus, the train detection signal A 20 and the train detection signal B 21 enable train detection via a principle similar to embodiment 2, while the additionally provided train control signal 24 constitutes a circuit flown through three rails.

The common transmitter 15 transmits a signal having superposed three frequencies, which are the train detection signals A+B 19 and the train control signal 24. As for train detection, the signals are used for train detection via the same principle as that of embodiment 2. When the presence of a train is detected, a train control signal 24 including a telegraphic message corresponding to the type of the train present on the track is transmitted.

The train control signal 24 has a frequency that passes both the filters A 17 and B 18, so that the signal is transmitted to both the standard track rail 1 and the narrow track rail 2. For example, when the train A 22 is present on the track, the axles of the train A 22 short the standard track rail 1 and the common rail 3 together.

An on-train receiver 25 is disposed on the train A 22, wherein a magnetic field 26 generated by the train control signal 24 flowing through the standard track rail 1 and the common rail 3 is excited to receive the telegraphic message to be used for train control.

Embodiment 3 illustrates an example in which a common transmitter and a common receiver are applied to the system as shown in FIG. 6, but it is also possible to apply the transmitters and receivers as illustrated in embodiment 1. Further, the present embodiment is capable of adopting the common transmitter 15 in combination with receivers A and B or adopting the transmitters A and B in combination with the common receiver 16.

[Embodiment 4]

Figure 7:
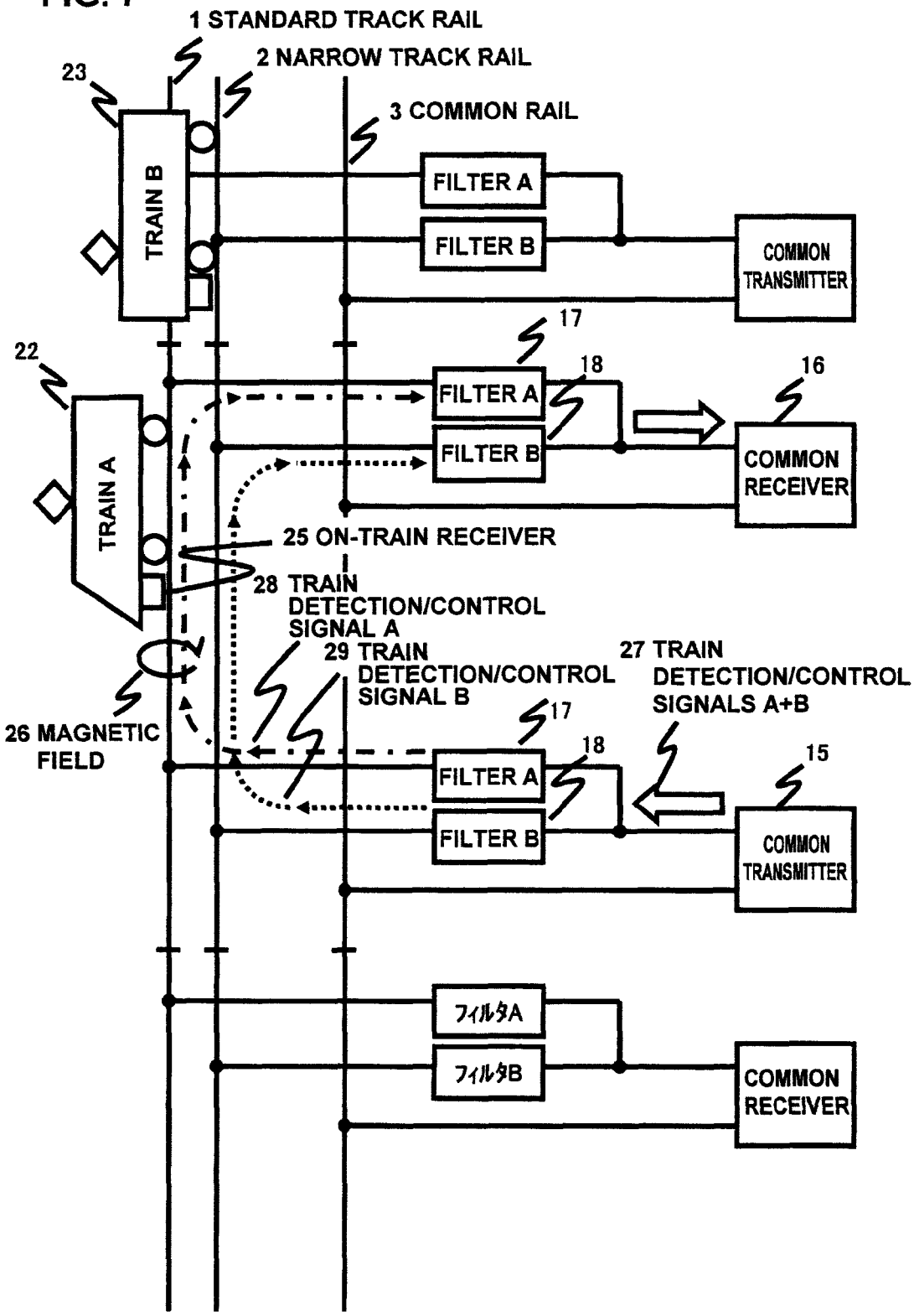
FIG. 7 is an explanatory view showing the arrangement of a train security device for an insulated dual gauge track circuit (embodiment 4)
Figure 8:
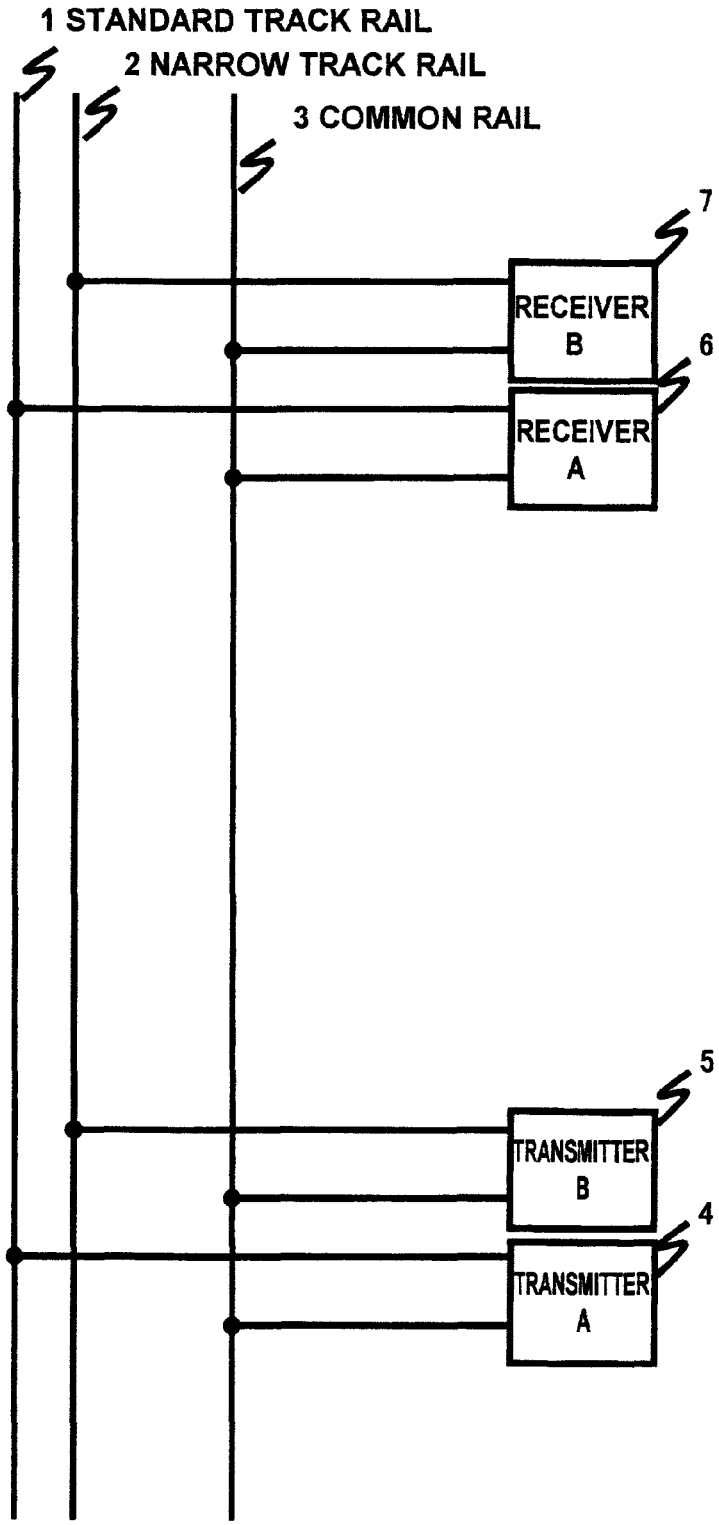
FIG. 8 is an explanatory view showing the arrangement of a well known dual gauge track circuit.
Figure 9:
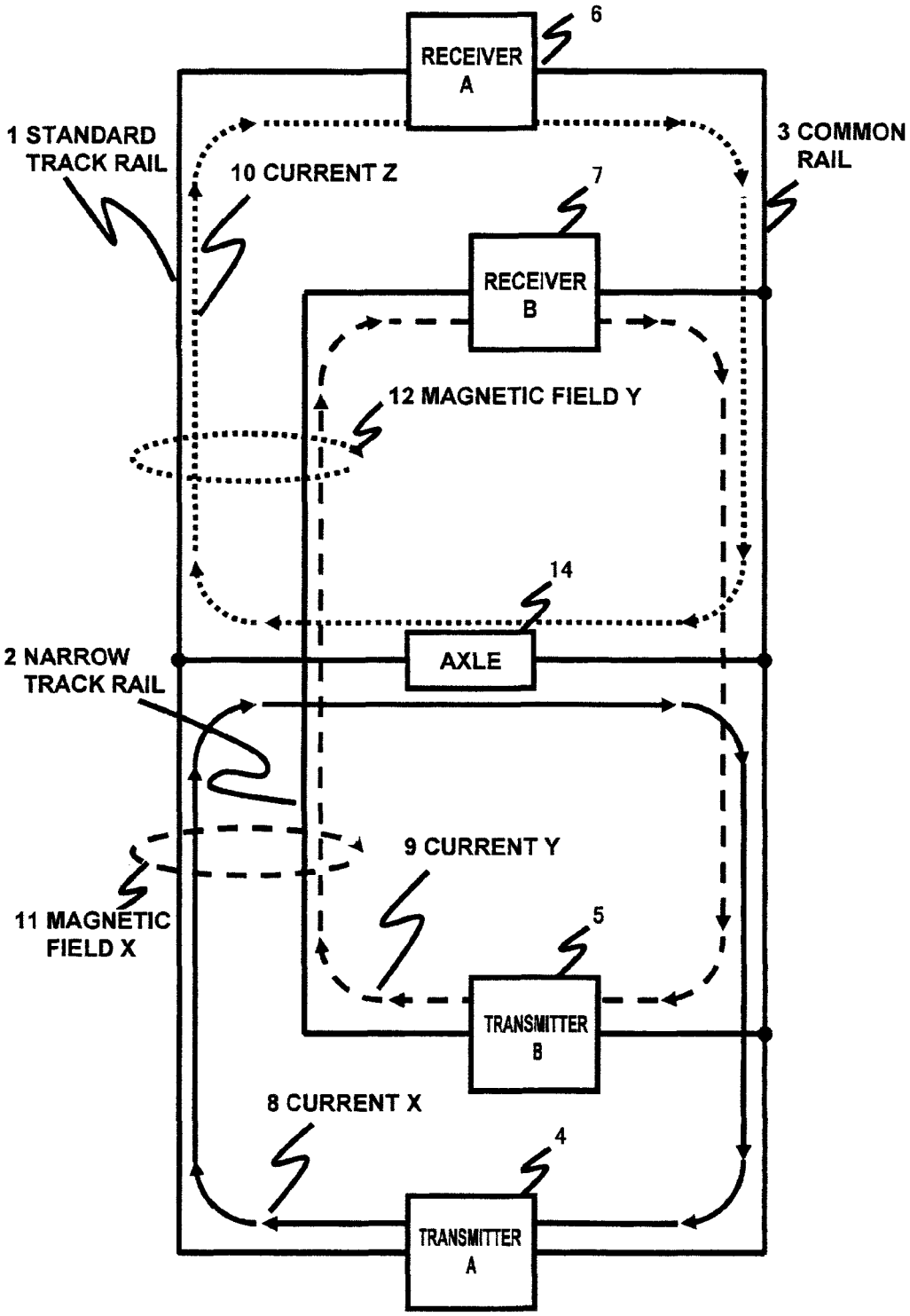
FIG. 9 is an equivalent circuit of the dual gauge track circuit when trains are present on the track.

Next, we will describe an embodiment in which the present invention is applied to an insulated dual gauge track circuit. FIG. 7 shows a block diagram of a track circuit arrangement. A common transmitter 15, a common receiver 16 and filters A 17 and B 18 are connected via the same arrangement as embodiment 2 to an insulated dual gauge track circuit. The basic arrangement is the same, but the present embodiment characterizes in that train detection and train control are performed simultaneously by adding a train control telegraphic message to the signal for train detection transmitted from the common transmitter 15.

The arrangement of frequencies of the train detection/control signal A 28 and the train detection/control signal B 29 and the relationship of selection characteristics of the filters A 17 and B 18 are the same as embodiment 2. The common transmitter 15 transmits train detection/control signals A+B 27 having superposed two kinds of signals, a train detection/control signal A 28 used for performing presence detection and train control of the train A 22 and a train detection/control signal B 29 used for performing presence detection and train control of the train B 23.

As mentioned earlier, the train detection/control signal A 28 and the train detection/control signal B 29 are signals in which a train control telegraphic message is added to the train detection signal A 20 and the train detection signal B 21 according to embodiment 2.

The train detection/control signals A+B 27 transmitted from the common transmitter 15 are passed through filters A 17 and B 18 and sent to an insulated dual gauge track circuit. The filters A 17 and B 18 split the train detection/control signals A+B 27 into a train detection/control signal A 28 and a train detection/control signal B 29, so that two closed loops of the train detection/control signal A 28 and the train detection/control signal B 29 are independently formed on the three rails.

On the receiver side, after passing the filters A 17 and B 18 from the rail, the detection/control signal A 28 and the train detection/control signal B 29 are superposed as train detection/control signals A+B 27 and entered to the common receiver 16. The common receiver 16 receives the train detection/control signals A+B 27, and monitors the respective signal levels of the train detection/control signal A 28 and the train detection/control signal B 29. When the axles of the train A 22 or the train B 23 short the two rails together, the level of only the relevant train detection signal is dropped, so that the receiver can detect the type of the train and the presence of the train on the track based on the signal frequency whose level has dropped.

Further, the train detection/control signal A 28 and the train detection/control signal B 29 flowing through the rail generates a magnetic field 26 around the rail. The magnetic field 26 excites the on-train receiver 25 of the train present on the track, and the telegraphic message for train control added on the rain detection/control signal A 28 or the train detection/control signal B 29 is transmitted to the train where the message is used for train control.

Embodiment 4 illustrates an example in which common transmitters 15 and common receivers 16 are adopted as shown in FIG. 7, but it is also possible to adopt the transmitters and receivers as shown in embodiment 1. Moreover, it is possible to use the common transmitter 15 in combination with the receivers A and B or to use the transmitters A and B in combination with the common receiver 16.

What is claimed is:

1. A train detector for detecting presence of a first train and a second train on a track respectively, by transmitting a train detection signal to a dual gauge track circuit having a first rail, a second rail and a common rail, the first train traveling on the first rail and the common rail, and the second train having a gauge different from the first train and traveling on the second rail and the common rail, wherein the train detector comprises:

a first transmitter for transmitting a first train detection signal having a predetermined frequency to the first rail;

a first receiver for receiving the first train detection signal from the first rail;

a second transmitter for transmitting a second train detection signal having a frequency different from the first train detection signal to the second rail;

a second receiver for receiving the second train detection signal from the second rail a first filter connected between the first rail and the first receiver and designed to pass a frequency band of the first train detection signal and to increase an impedance at a frequency band of the second train detection signal so as to suppress a current of the second train detection signal; and a second filter connected between the second rail and the second receiver and designed to pass a frequency band of the second train detection signal and to increase an impedance at a frequency band of the first train detection signal so as to suppress a current of the first train detection signal;

so as to prevent deficiency of attenuation of train detection signals when trains are present on the track, the deficiency being caused by mutual induction between the first rail and the second rail, that is specific to the dual gauge track circuit.

2. A train detector for detecting presence of a first train and a second train on a track respectively, by transmitting a train detection signal to a dual gauge track circuit having a first rail, a second rail and the common rail, the first train traveling on the first rail and the common rail, and the second train having a gauge different from the first train and traveling on the second rail and the common rail, wherein the train detector comprises:

a common transmitter for transmitting a first train detection signal having a predetermined frequency and a second train detection signal having a frequency different from the first train detection signal to the first rail and the second rail;

a common receiver for receiving the first train detection signal from the first rail and the second train detection signal from the second rail;

a first filter connected between the first rail and the common receiver and designed to pass a frequency band of the first train detection signal and to increase an impedance at a frequency band of the second train detection signal so as to suppress a current of the second train detection signal;

a second filter connected between the second rail and the common receiver and designed to pass a frequency band of the second train detection signal and to increase an impedance at a frequency band of the first train detection signal so as to suppress a current of the first train detection signal;

a third filter connected between the common transmitter and the first rail and designed to pass a frequency band of the first train detection signal and to increase an impedance at a frequency band of the second train detection signal so as to suppress the current of the second train detection signal; and a fourth filter connected between the common transmitter and the second rail and designed to pass a frequency band of the second train detection signal and to increase an impedance at a frequency band of the first train detection signal so as to suppress the current of the first train detection signal, so as to prevent deficiency of attenuation of train detection signals when trains are present on the track, the deficiency being caused by mutual induction between the first rail and the second rail, that is specific to the dual gauge track circuit.

3. The train detector according to claim 2, wherein the train detector has both of a train detection function and a train control function by setting the frequency of a train control signal in a band range in the middle of the frequencies of the first train detection signal and the second train detection signal and in the band range that passes the first, second, third, and fourth filters, and by transmitting the first train detection signal, the second train detection signal and the train control signal from the common transmitter to the first and second rails.

4. The train detector according to claim 2, wherein the common transmitter adds a first train control telegraphic message to be used for a first train control to the first train detection signal and a second train control telegraphic message to be used for a second train control to the second train detection signal, and transmits the first and second train detection signals to which the train control telegraphic messages are added to the first and second rails.

* * * * *